US006485137B2

(12) United States Patent
Karlinski et al.

(10) Patent No.: US 6,485,137 B2
(45) Date of Patent: Nov. 26, 2002

(54) CLOSED INK DELIVERY SYSTEM WITH PRINT HEAD INK PRESSURE CONTROL AND METHOD OF SAME

(75) Inventors: Haggai Karlinski, Ramat Gan (IL); Rafael Ambar, Ramat Gan (IL); Yossi Goldman, Kfar Yona (IL); Alex Markman, Tel Aviv (IL); Gil Fisher, Petach Tikva (IL); Eli Voronski, Ramat Hasharon (IL); David Feiner, Ra'anana (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 09/983,005

(22) Filed: Oct. 22, 2001

(65) Prior Publication Data

US 2002/0047882 A1 Apr. 25, 2002

Related U.S. Application Data

(60) Provisional application No. 60/242,141, filed on Oct. 23, 2000, and provisional application No. 60/288,817, filed on May 7, 2001.

(51) Int. Cl.[7] ..... B41J 2/19; B41J 2/175; B41J 2/18

(52) U.S. Cl. ..... 347/92; 347/85; 347/89

(58) Field of Search ..... 347/92, 85, 86, 347/87, 89, 94, 7

(56) References Cited

U.S. PATENT DOCUMENTS

| | | | | | |
|---|---|---|---|---|---|
| 4,347,524 | A | * | 8/1982 | Engel et al. | 347/94 |
| 4,558,326 | A | * | 12/1985 | Kimura et al. | 347/30 |
| 5,367,328 | A | * | 11/1994 | Erickson | 347/7 |
| 5,485,187 | A | * | 1/1996 | Okamura et al. | 347/85 |
| 5,963,237 | A | * | 10/1999 | Ikkatai et al. | 347/85 |
| 6,059,405 | A | * | 5/2000 | Mochizuki et al. | 347/92 |
| 6,315,402 | B1 | * | 11/2001 | Kawase | 347/85 |

* cited by examiner

*Primary Examiner*—Michael Nghiem
(74) *Attorney, Agent, or Firm*—Eitan Pearl Latzer & Cohen-Zedek

(57) ABSTRACT

In some embodiments of the present invention, an ink supply system is provided. The system may include a first stationary fluid storage unit, a second stationary fluid storage unit coupled to the first stationary fluid storage unit and an air lung. The system may also include a collapsible fluid level bag positionable lower than nozzles of one or more print heads and a movable fluid pressure damper coupled to the fluid level bag and to the print heads. The system is configured such that when printing, ink is exposed to the ambient atmosphere only at the nozzles.

14 Claims, 6 Drawing Sheets

CLOSED INK DELIVERY SYSTEM WITH PRINT HEAD INK PRESSURE CONTROL AND METHOD OF SAME

CROSS-REFERENCE TO RELATED APPLICATIONS

The present application claims priority from both U.S. provisional application Ser. No. 60/242,141, filed Oct. 23, 2000 and U.S. provisional application Ser. No. 60/288,817, filed May 7, 2001.

BACKGROUND OF THE INVENTION

Industrial inkjet printers are typically large format machines capable of printing on various substrates at high printing speeds. In these machines, the print head may comprise a linear or a two-dimensional array of nozzles. Continuous printing on large formats at high printing speeds and with a large number of nozzles requires a continuous supply of relatively large amounts of ink. In order to ensure the quality of printing, it is desirable to use dearated ink, to reduce fluctuations in the ink pressure and to maintain the ink pressure at the print-head lower than the ambient atmospheric level.

Some printing systems use an ink supply system that comprises a large stationary ink tank, and a small movable tank that moves along with the print head. The ink is periodically replenished from the stationary tank to the movable tank, however the mount of ink stored in the movable tank is very small and it has a complicated structure hat is not suitable to many applications.

Other printing systems dearate ink by applying vacuum close to the print heads, thus complicating the structure of the print head.

BRIEF DESCRIPTION OF THE DRAWINGS

The subject matter regarded as the invention is particularly pointed out and distinctly claimed in the concluding portion of the specification The invention, however, both as to organization and method of operation, together with objects, features, and advantages thereof, may best be understood by reference to the following detailed description when read with the accompanying drawings in which:

Figure 1:
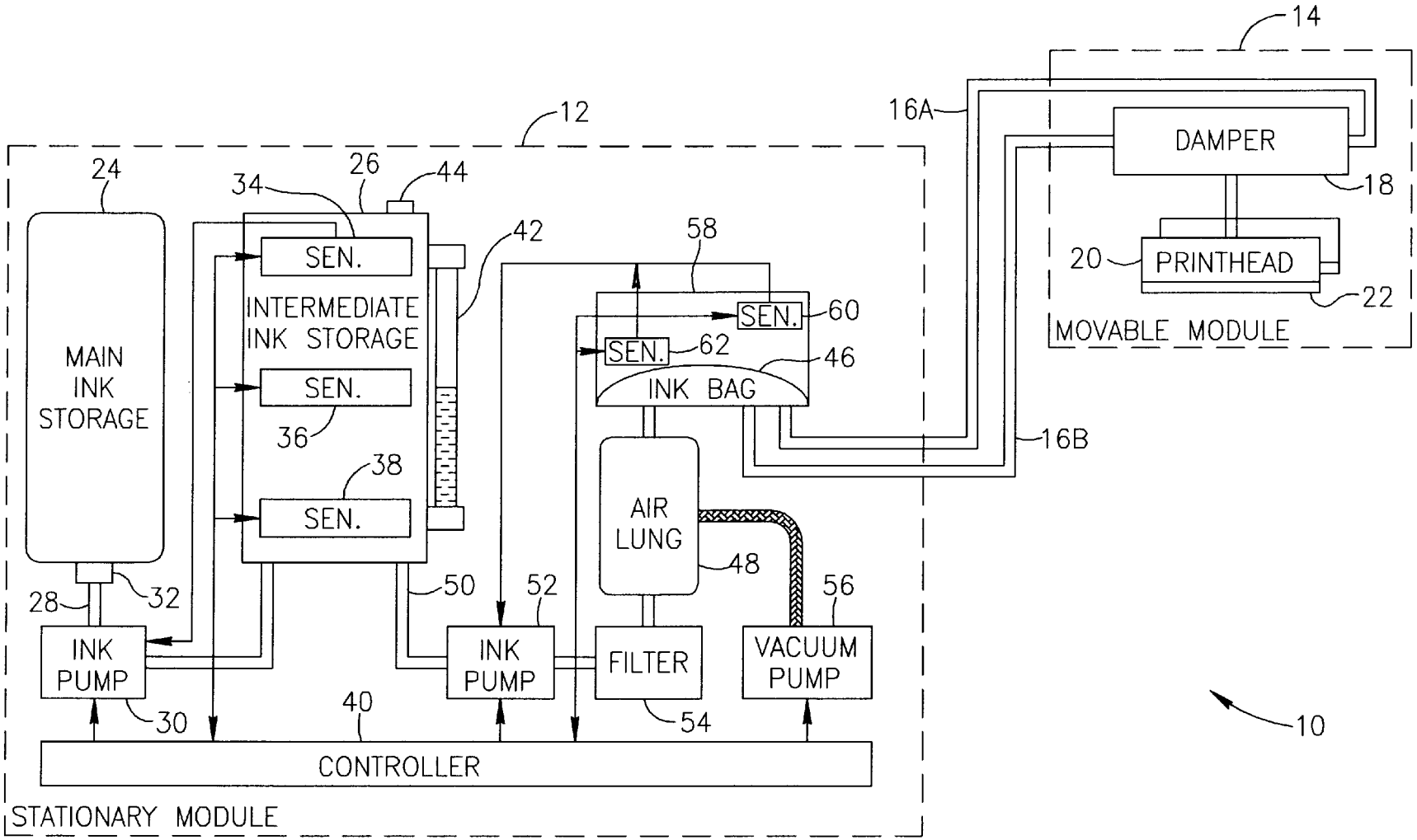
FIG. 1 is a schematic block diagram of an inking system according to some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Reference is now made to FIG. 1, which is a schematic block diagram of an inking system, generally designated 10 according to some embodiments of the present invention.

Inking system 10 may comprise a stationary module 12 and a movable module 14 coupled stationary module 12 via flexible pipes 16*a* and 16*b*. Movable module 14 may comprise a damper 18 coupled via pipes to one or more print heads 20. A valve (not shown) capable of switching on and off the ink flow to a respective print head 20 may be coupled to each pipe. Each print head may comprise a plurality of nozzles 22. Movable module 14 is described in detail hereinbelow with respect to FIGS. 2–5.

Stationary module 12 may comprise a main ink storage 24 and an intermediate ink storage 26 coupled to main storage 24 via a pipe system 28 and an ink pump 30. Main ink storage 24 may be a collapsible bag supported by a rigid structure, such as, for example, a corrugated box. Alternatively, storage 24 may be a bottle. Main storage 24 may store a relatively large amount of ink, for example, 4 liters. The ink may be degassed and sealed by the ink manufacturer. Main storage 24 may comprise a fitting 32. The specific structure of fitting 32 may depend on the type of main storage 24.

Main ink storage 24 may provide ink to intermediate storage 26 using ink pump 30. Non-limiting examples of such a pump include a peristaltic pump, a diaphragm pump and any other type of pump operative to supply ink.

Intermediate ink storage 26 may comprise an overflow sensor 34, a working-level sensor 36 and low-level sensor 38. Low-level sensor 38 may prevent entrance of air into the system. When the ink stored in intermediate storage 26 reaches a predefined low-level, sensor 38 may provide a signal to a controller 40. Controller 40 may be a personal computer or a dedicated unit. Controller 40, then, may activate ink pump 30 to replenish the ink at intermediate storage 26. If controller 40 fails to activate pump 30, the printing may stop and main ink storage 24 may be replaced off-line.

Main storage 24 may be replaced on-line, during printing, while intermediate storage 26 may continue to provide ink for printing. When the ink stored in intermediate storage 26 reaches a predefined working-level, working-level sensor 36 may provide a signal to controller 40. Controller 40, then, may de-activate ink pump 30 to enable the replacement of main storage 24. In the meanwhile, there may be sufficient ink in intermediate storage 26 to provide ink for the system for a time sufficient to replace main storage 24.

Overflow sensor 34 may be coupled directly to ink pump 30. When the ink stored in intermediate storage 26 reaches a predefined overflow level, overflow sensor 34 may provide a signal to pump 30 to discontinue pumping ink from main storage 24. Overflow sensor 34 may be further coupled to controller 40 for alerting and controlling purposes.

Intermediate storage 26 may further comprise a transparent tube 42 coupled to the content of intermediate storage 26 and able to provide a visual inspection to an operator regarding the level of ink. Intermediate storage 26 may further comprise a vent opening 44 for keeping the pressure at intermediate storage 26 generally at the ambient atmospheric pressure.

Stationary module 12 may further comprise an ink level bag storage 46 and an air lung 48 coupled to ink level bag storage 46 and to intermediate storage 26. Air lung 48 may be coupled to intermediate storage 26 via a pipe system 50, an ink pump 52 and a filter 54. Intermediate storage 26 may provide ink to ink level bag storage 46 via filter 54 and air lung 48, so that the ink is filtered and degassed by the time it reaches level bag 46.

Ink pump 52, which may be similar to pump 30, may be coupled to controller 40. Filter 54 may be able to filter impurities from the ink, thus preventing the clogging of lung 48 and nozzles 22.

Stationary module 12 may further comprise a vacuum pump 56 coupled to air lung 48. During printing, vacuum pump 56 may continuously apply a vacuum to air lung 48, which may remove air dissolved in the ink. An exemplary air lung is commercially available from Dainippon Ink Company of Tokyo, Japan.

Ink level bag 46 may be a collapsible bag inside a rigid box 58 and may be coupled via flexible pipes 16*a* and 16*b* to damper 18. Rigid box 58 may further comprise a bag overflow sensor 60 and an ink level sensor 62, which may be coupled to controller 40. Bag overflow sensor 60 may be further coupled to ink pump 52.

Ink level bag 46 may be coated with aluminized polyester (PET) film so as to reduce air permeability. Ink level bag 46 may enable generating such a pressure in movable module 14 so as to enable dropping ink on-demand from nozzles 22.

Ink level bag 46 may be positioned lower than print heads 20 and its nozzles 22. This positioning of ink level bag 46 relative to nozzles 22 may create a pressure that is lower than atmospheric pressure at the nozzles. The lower pressure may prevent dripping of ink in the absence of a pulse that activates a particular nozzle. A difference approximately −5 to 40 mm water between the pressure at ink level bag 46 and the pressure at nozzles 22 may be sufficient for proper print head operation.

Ink level bag 46 may be maintained generally full of ink so as to ensure a continuous supply of ink to print heads 20 at a desired pressure. Bag overflow sensor 60 and ink-level sensor 62 may control the ink level of ink level bag 46.

When the ink stored in bag 46 reaches a predefined working-level ink-level sensor 62 may provide a signal to controller 40. Controller 40 may then de-activate ink pump 52 to replenish the ink at bag 46. When the ink reaches a predefined low-level, sensor 62 may provide a signal to controller 40. Controller 40 may then activate ink pump 52. When bag overflow sensor 62 detects an overflow at a predefined level, it may directly de-activate ink pump 52.

Ink level bag 46 may further enable fast and reliable print head maintenance. Rigid box 58 may be coupled to a source of pressure (not shown), such as, for example, an air compressor or a pump able to generate a pressure higher than the atmospheric pressure at ink level bag 46. The excessive pressure may push the ink from ink level bag 46 via damper 18 and out of nozzles 22. Alternatively, the excessive pressure in ink level bag 46 may be applied manually. The excessive pressure may purge the inking system from both air bubbles and ink debris.

It should be noted that the system described above is exemplary and there may be more storage units, filters and pumps in stationary module 12.

Ink level bag 46 may deliver ink to damper 18 of movable module 14 via flexible pipes 16A and 16B. During printing, movable module 14 reciprocates above a substrate (not shown) to be printed. The reciprocating movement of print heads 20 and damper 18 may create fluctuations in the ink pressure, which may exceed 150 mm of water. Damper 18 may reduce or eliminate the pressure variations, as will be described hereinbelow.

Figure 2:
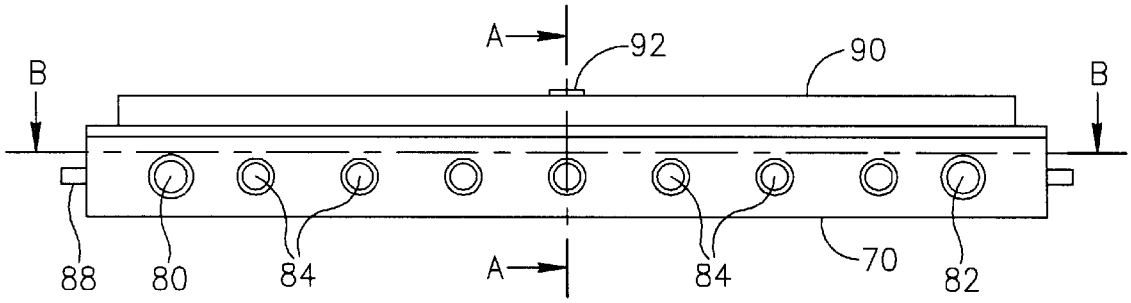
FIG. 2 is a schematic illustration of a damper unit according to some embodiments of the present invention.
Figure 3:
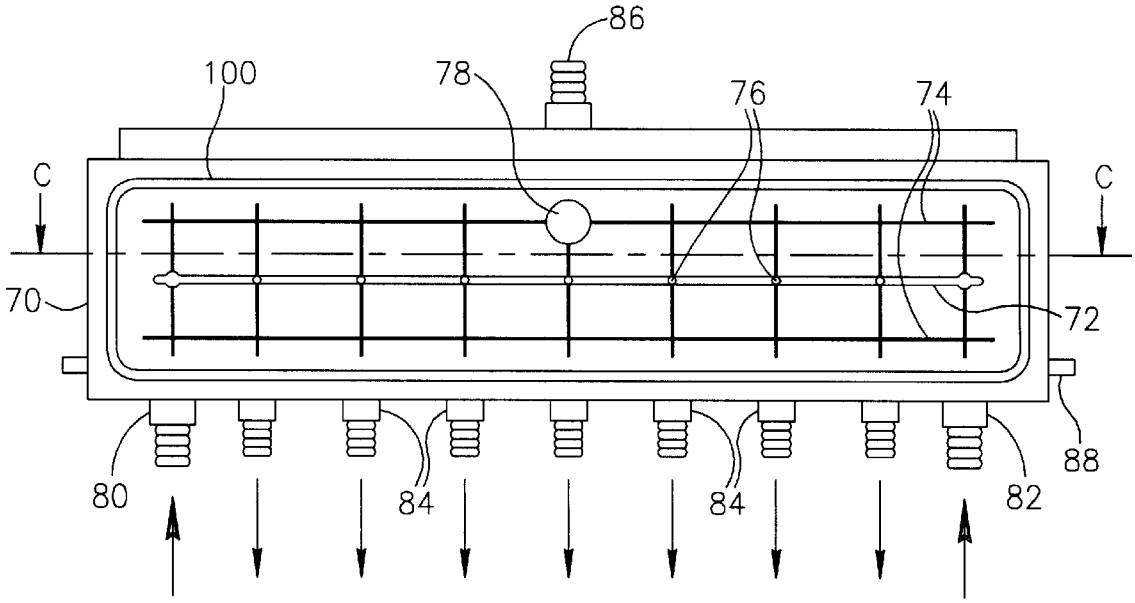
FIG. 3 is a cross section view across e B—B plane of FIG. 2.

Reference is now made to FIG. 2, which is a schematic illusion of a damper unit according to some embodiments of the present invention. Reference is also made to FIG. 3, which is a cross section view across the B—B plane of the damper of FIG. 2 and to FIG. 4, which is a cross section view across the A—A plane of the damper of FIG. 2.

Damper 18, which may be described as a manifold, may comprise a body 70 having at least one deep channel 72 and at least one shallow channel 74, all in fluid communication therebetween. Deep channel 72 may comprise one or more openings 76 through which ink may be transferred. One of shallow channels 74 may comprise an opening 78 for evacuating air from damper 18.

Body 70 may further comprise a first ink-income fitting 80, a second ink-income fitting 82 and one or more outlet fittings 84, each outlet fittings 84 coupled to a respective print head 20. Body 70 may operate as a manifold distributing ink to outlet fittings 84. Body 70 may further comprise an air-purge fittings 86, which is placed on a face opposite to fittings 80, 82 and 84 and may he coupled to opening 78.

Damper 18 may further comprise one or more hinges 88, each located at opposite faces perpendicular to the faces having the fittings, a cover 90 and a vent opening 92.

Figure 4:
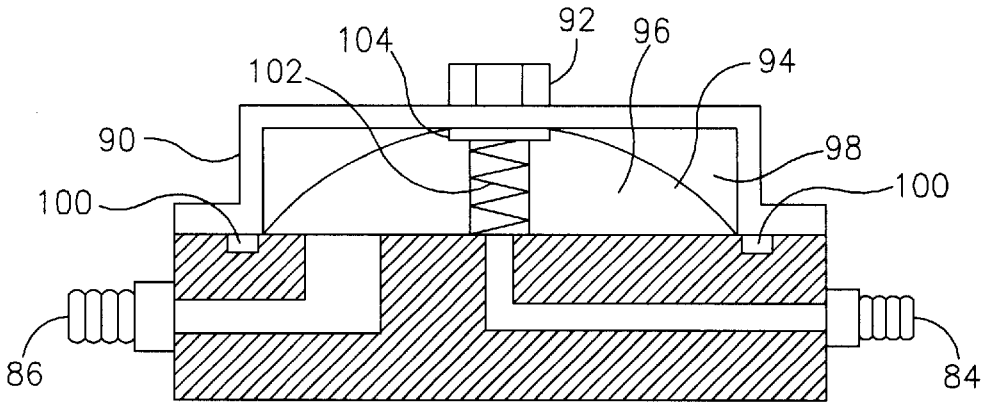
FIG. 4 is a cross section view across the A—A plane of FIG. 2.

Damper 18 may further comprise a flexible film membrane 94 (as can be seen at FIG. 4) having a low permeability to air. Membrane 94 may be coated with aluminized PET or metallized polyvinyl fluoride (PVF) to reduce air permeability. Membrane 94 may be positioned inside body 70 to create two separate spaces within body 70, an ink space 96, which may be filled with ink and an air space 98, which may be filled with air. Vent opening 92 may enable air space 98 to be coupled to the atmosphere.

Damper 18 may further comprise one or more gaskets 100. Ink space 96 may be hermetically sealed by pressing cover 90 over membrane 94 and by using gaskets 100. Alternatively, film membrane 94 may be glued or welded to gaskets 100 and to body 70. Damper 18 may farther comprise one or more springs 102, each coupled to a lever 104. Springs 102 may be inserted into openings 76 of FIG. 3.

The operation of damper 18 is now described hereinbelow. Damper 18 may be rotated on hinges 88 and placed with fitting 84 substantially facing down. A valve (not shown) may be connected to air purge fitting 86 and may apply a vacuum to damper unit 18. Air bubbles in the ink may be evacuated via opening 78. Shallow channels 72 may facilitate the air evacuation.

Following the priming operation, ink may be provided to damper 18 via ink income fittings 80, 82. The ink may enter ink space 96 via deep channels 72 and openings 76. Ink space 96 may be kept at a pressure lower than the atmospheric pressure. This lower pressure may be generated by positioning ink level bag 46 lower than nozzles 22.

Springs 102 may counteract the atmospheric pressure that operate on membrane 94 and may enable membrane 94 to remain stretched. Consequently, the pressure of ink stored in ink space 96 may remain constant even when a change in the ink volume occurs. During the reciprocal movement of print head 20, the print head accelerates and decelerates interchangeably. The ink stored in space 96 may move to the other direction and may generate pressure on flexible film membrane 94. Under these forces, membrane 94 may slightly change its positioning within body 70 in order to restore the equilibrium pressure.

Springs 102 may continue to keep the membrane stretched, although some sag may occur. Nevertheless, such a small change in the volume of ink in ink space 96 may not practically affect the pressure at nozzles 22, as required. The structure of damper 18 may reduce pressure fluctuations to an acceptable level.

Figure 5A:
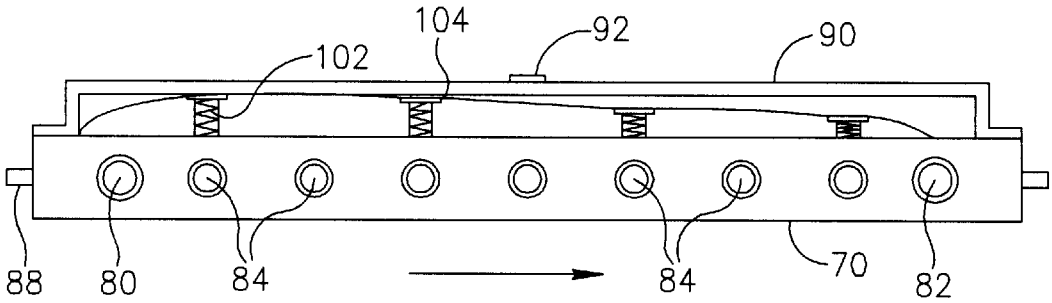
FIGS. 5A and 5B are cross section views across the C—C plane of FIG. 3.
Figure 5B:
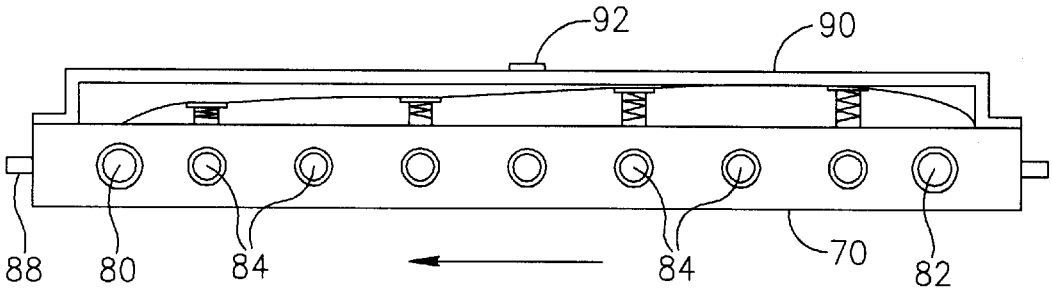

Reference is now made to FIGS. 5A and 5B, which are cross section views across the C—C plane of FIG. 3 illustrating the operation of the damper unit of FIG. 2 according to some embodiments of the present invention. When print head 20 together with damper 18 moves to the right (FIG. 5A), the ink stored in ink space 96 may move within membrane 94 to the left. The atmospheric pressure under cover 90 may press on flexible membrane 94, on lever 104 and on springs 102.

Flexible film membrane 94 may change its form according to the forces acting on springs 104. The right side of membrane 94 may be lowered, while the left side of membrane 94 may be lifted. Despite the deformation of membrane 94, the volume of ink space 96 may remain constant, thus preventing changes in the pressure of ink stored in it.

Figure 6:
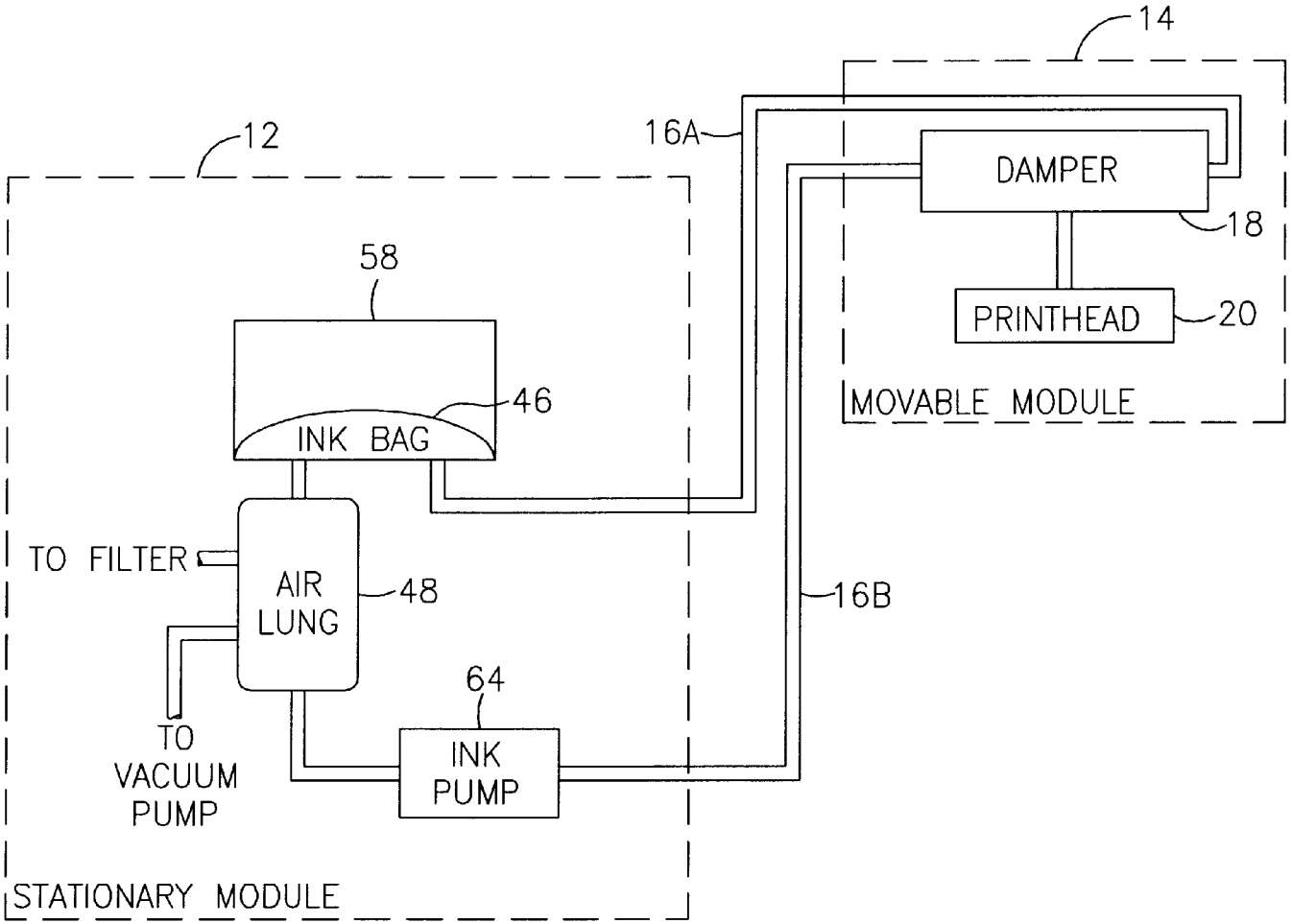
FIG. 6 is a schematic block diagram of an inking system having an ink circulation loop according to some embodiments of the present invention.

Reference is now made to FIG. 6, which is a schematic block diagram of an inking system having an ink circulation loop according to some embodiments of the present invention. In these embodiments, ink level bag 46 may be coupled to damper 18 via a single outlet connected to flexible pipe 16A.

Stationary module 12 may further comprise an ink pump 64 coupled to the inlet of air lung 48 and to damper 18. Ink pump 64 may be, for example, a peristaltic pump, a diaphragm pump or any other suitable device. Ink pump 64 may pump unused ink from damper 18 via a flexible pipe 66 back into air lung 48. Air lung 48 may then extract dissolved air from the recycled ink.

Figure 7:
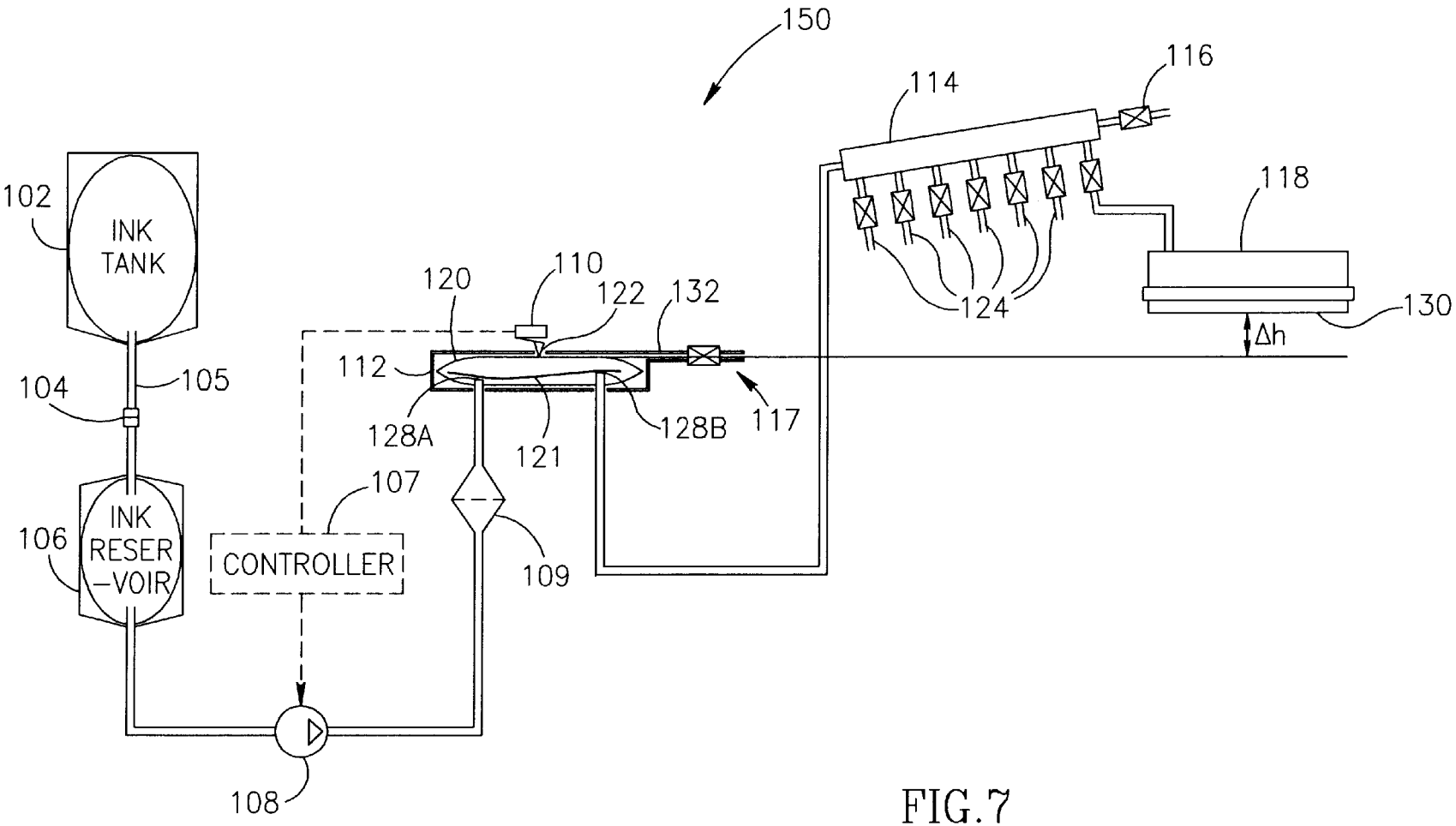
FIG. 7 is a schematic block diagram of an inking system having an ink bag according to some embodiments of the present invention.

Reference is now made to FIG. 7, which is a schematic block diagram of an ink delivery system having an ink bag according to some embodiments of the present invention. Ink delivery system 150 may comprise a collapsible ink bag 120, a casing 112, a microswitch 110 and an associated lever 122, and may be coupled to a manifold 114 having a plurality of ball valves 124, and a drain ball valve 116. Manifold 114 may be further coupled to a plurality of print heads 118, wherein typically each print head 118 is associated with one ball valve 124. Ink delivery system 150 optionally may comprise an ink tank 102, a shutoff coupling 104, interconnecting tubing 105, an ink reservoir 106, an ink pump 108 with an associated controller 107, and a filter 109.

Ink tank 102 may be a flexible container such as such, for example, polyethylene and polypropylene. The container may be positioned within a rigid box, such as for example a cardboard box. The ink tank 102 may contain degassed ink and may be sealed after being filled with ink. Typically, the ink is degassed before it is introduced into the ink tank 102. Degassing may take place either during the ink-manufacturing phase or via an automated degassing system. As ink is consumed during the printing process, ink tank 102 slowly collapses. When ink tank 102 is completely depleted, it is replaced by a full tank of ink.

Shutoff coupling 104 may be a quick fitting connector made of two shutoff plugs. During replacement of empty ink tank 102, both shutoff plugs of coupling 104 may be disconnected to prevent ink from dripping out of, or air from entering into, ink delivery system 150. After reconnection, any small amount of air trapped in shutoff coupling 104 may be pushed up into ink tank 102 by squeezing ink reservoir 106. Alternatively, trapped air may be pushed into main ink tank 102 by pressing interconnecting tubing 105. Tubing 105 may connect, directly or indirectly, ink tank 102 to ink reservoir 106.

Ink reservoir 106 may be a flexible container similar to ink tank 102. In order to expel possible trapped air into tank 102, ink reservoir 106 may be squeezed either by activate force on the reservoir 106 or by applying pressure to the casing of the reservoir.

One of the purposes of ink reservoir 106 is to continue delivery of ink to ink bag 120 while ink tank 102 is being replaced. According to some embodiments of the present invention, collapsible ink bag 120 is dimensioned such as to effectively take over the reservoir function of ink reservoir 106. In these embodiments, ink reservoir 106 is optional and may be eliminated.

Ink pump 108 may be a peristaltic fluid pump, such as that used in known fluid dispense systems or any other type of suitable fluid pump. Pump 108 may pump the ink through filter 109 into ink bag 120. Optionally, ink pump 108 may comprise shut off valves (not shown) at the entrance and the exit of the pump to enable the removal of ink pump 108 for periodical maintenance.

Pump controller 107 may be electrically coupled, either directly or indirectly, to pump 108. Dependent upon the type of pump 108 and microswitch 110 utilized, controller 107 may measure the amount of ink consumed. This may be accomplished by any appropriate method such as: to measure the ink flow from pump 108, or if the rate of the ink flow is known, to measure the amount of time that pump 108 is operated, or to measure the ink output from bag 120, or any other operable method.

Filter 109 may filter the ink and may be positioned in a positive pressure zone, such as that between pump 108 and ink bag 120. In such a manner, the flow resistance of filter 109 may not effect print heads 118. Alternatively, filter 109 may be positioned between ink bag 120 and manifold 114.

Ink bag 120 may be a sealed flexible bag that contains ink and may be housed inside casing 112. Ink bag 120 may comprise a tube 128A and a tube outlet 128B. The ink flows from filter 109 to bag 120 entering via tube inlet 128A and exiting through to tube outlet 128B. Tube inlet 128A and outlet 128B may be coupled to pressure control bag 120 through nipple connectors (not shown).

It is noted that when using ink bag 120 for the first time, a vacuum may be created therein, and then bag 120 may be filed with degassed ink.

Bag 120 may further comprise a rigid plastic net 121 in order to prevent the sides of the bag from collapsing one onto the other. Net 121 may be made from a material such as polyethylene and be situated on the inside base of bag 120. The presence of net 121 inside 120 may inhibit the sides of the bag from sticking one to the other. Typically, net 121 is slightly smaller than the inside base of bag 120, thus dividing bag 120 and helping to evenly distribute the vacuum throughout bag 120.

Bag 120 may be similar in structure to ink tank 102 and may be made of any flexible material such as polyethylene, polypropylene, and other applicable materials. Typically the material composition of ink bag 120 is inert to ink and impregnable to air. Generally, as ink flows out outlet 128B, bag 120 collapses. Since system 150 is a closed air system ink bag 120 contains substantially no air.

For purposed of the explanation to follow, it is noted that print heads 118 have an underside 130. The distance between a topside 132 of bag 120 and underside 130 is generally referenced as Δh, a distance which is generally appropriate to maintain a negative pressure at the ink heads 118 in order to substantially eliminate ink leakage from the ink nozzles. It is desirable to maintain Δh as relatively constant as possible. This may be accomplished by keeping the height of topside 132 relatively stable, which indicates that the volume of ink inside bag 120 also remains relatively stable. This in turn helps to maintain a relatively stable Δh.

To enable keeping topside 132 relatively stable, microswitch 110 is positioned at a pre-defined position relative to underside 130 and topside 132. It is noted that microswitch 110 may be located outside of rigid case 112. In this instance, microswitch 110 may be coupled to lever 122 that and hence may contact topside 132. Microswitch 110 is typically sensitive to movements of lever 122 as small as 3–5 mm.

When topside 132 partially collapses or drops, lever 122 moves, activating microswitch 101, which in tun activates pump 108. Pump 108 causes ink to flow into inlet 128A, thus causing ink bag 120 to refill. Lever 122 rises to its original level, at which point microswitch 110 deactivates pump 108. As can be seen, microswitch 110, lever 122, ink bag 120 and ink pump 108 include a closed loop control system.

It is noted that microswitch 10 may activate pump 108 via controller 107, or alternatively, may activate pump 108 via other direct or indirect means, which may or ay not include external means. Furthermore, other means of detecting height of pressure control bag 120, or optionally, detecting volume of pumped ink, weight of pumped ink, or any other physical property suitable for controlling desired hydraulic print head ink pressure are equally within the scope of the present invention.

Those versed in the art will recognize that the microswitch and lever technique as being similar to proximity sensor arrangement and therefore, any proximity sensor with positional sensitivity may be used, such as opto-electronic sensors or electro-magnetic sensors, and such.

Electro-magnetic sensors may use a permanent magnet as passive element affixed to the topside 132. Switching of an active element occurs at a precise, repeatable distance of the magnet from the active element. Opto-electronic sensors may have an illuminated gate as the active component. A vane, affixed to the topside 132, obstructs the light at a precise and repeatable vertical position in relation to the active gate and thus induces a switch in conductivity of the active gate.

Outlet 128B is typically positioned at mid-height of ink bag 120. Therefore, any trapped air (which would be located in the upper part of bag 120) or ink sedimentation (which would be tend to settle in the lower part of bag 120) can not exit pressure control bag 120 and reach print heads 118.

Placing ink bag 120 in closed rigid protective casing 112 allows for pressurizing the ink in the system. Compressed air can be introduced into reservoir casing 112 through orifice 117. Pressurizing the air in casing 112 compresses ink bag 120. This forces ink to eject from outlet 128B, thus pushing ink through the system and cleaning print heads 118. This pressurizing step is a maintenance function that may be performed periodically.

From tube outlet 128B ink is delivered to manifold 114, equipped with at least as many outlets 124 as there are print heads 118.

For ease of understanding, the following description relates to one print head 118, only. Those versed in the art will readily appreciate that the other print heads (not shown) and associated devices function substantially in similar fashion.

Ball valve 124 is positioned in the tubing between manifold 114 and print head 118. During drainage or pressurizing of parts of system 150, ball valves 124 may be used to shut off ink flow to associated print heads 118.

It is noted that manifold 114 may be slightly inclined and drain ball valve 116 is typically positioned at the most elevated part of manifold 114. Thus, any air trapped in the system may rise toward drain ball valve 116. Drain ball valve 116 may opened for air and/or ink drainage. As an example, in order to drain air from the ink, ink bag 120 may be pressurized, and any air trapped in the ink may be removed via drain ball valve 116.

Figure 8:
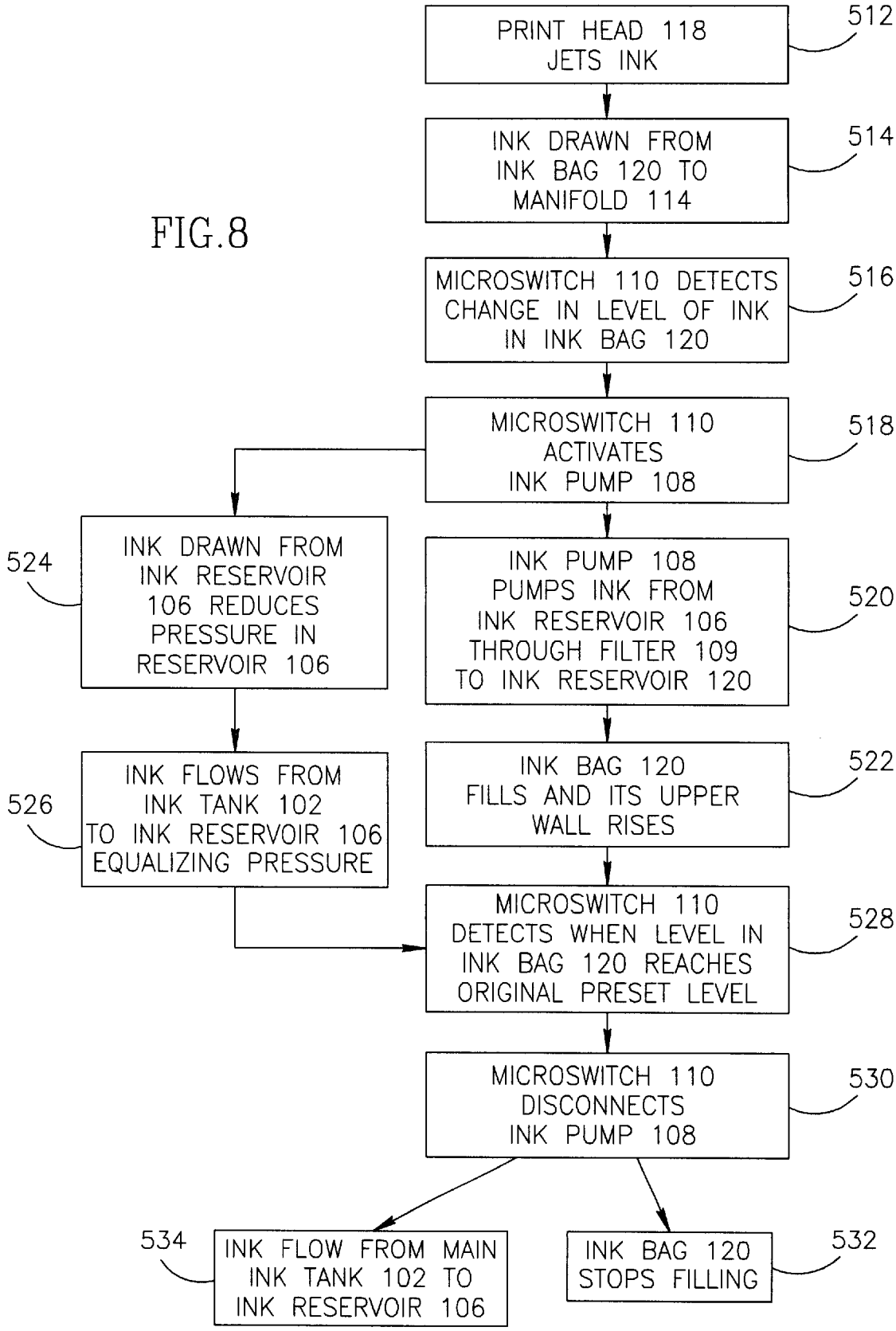
FIG. 8 is a schematic flow chart diagram of the operation of the system of FIG. 7.

A block diagram of the method of operation of ink delivery system 150 is shown in FIG. 8 to which reference is now made.

Print head 118 jets (step 512) ink onto a print medium creating a partial vacuum. Ink is then drawn (step 514) from ink bag 120 through manifold 114 toward print head 118. Topside 132 drops and lever 122 moves. Microswitch 110 detects (step 516) the decrease in height of topside 132 and activates (step 518) ink pump 108.

Ink pump 108 then draws (step 520) ink from ink reservoir 106 and pushes ink through filter 109 into ink bag 120. As ink is drawn from ink reservoir 106, there is a reduction (step 524) in pressure in bag 106.

Ink bag 120 fills (step 522) with ink and topside 132 rises. Lever 122 rises. Microswitch 110 detects (528) lever 122 has returned to its original, preset level. Microswitch 110 deactivates (step 530) pump 108 and ink bag 120 stops (step 532) As mentioned above, when ink is drawn (step 524) from ink reservoir 106, there is a drop in pressure in ink reservoir 106. To equalize pressure, ink flows (step 526) from ink tank 102 to ink reservoir 106. When microswitch 110 deactivates (step 528) ink pump 108, the flow from ink tank 102 to ink reservoir 106 ceases (step 534).

It should be noted that throughout the specification, the delivery system according to some embodiments of the present invention has been described with relation to ink. However, it should be understood to a person skilled in the art that other fluids may be used.

It will be appreciated by persons skilled in the art that the present While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A fluid supply system comprising:

a first stationary fluid storage unit;

a second stationary fluid storage unit coupled to said first stationary fluid storage unit;

an air lung coupled to said second stationary fluid storage unit;

a collapsible fluid level bag positionable higher than nozzles of one or more print heads and able to receive deaerated fluid from said air lung; and a movable fluid pressure damper coupled to said fluid level bag and to said one or more print heads.

2. The fluid supply system of claim 1, wherein said second stationary fluid storage unit comprises:

a low-fluid-level sensor;

an overflow-fluid-level sensor; and a working-fluid-level sensor.

3. The fluid supply system of claim 1 further comprising a vacuum unit coupled to said air lung.

4. The fluid supply system of claim 1, said system being configured such that when printing fluid is exposed to the ambient atmosphere only at said nozzles.

5. The fluid supply system of claim 1, wherein said first stationary fluid storage unit is replaceable during printing.

6. The fluid supply system of claim 1, wherein said fluid pressure damper comprises a flexible film membrane.

7. The fluid supply system of claim 1 further comprising a fluid pump coupled to said air lung and to said damper, thus creating a fluid circulation loop comprising said air lung, said fluid level bag, said fluid pressure damper and said fluid pump.

8. A fluid supply system comprising:

a fluid pressure damper able to reduce pressure fluctuations generated in fluid passing therethrough, wherein said damper comprises:

a flexible film membrane having low air permeability, said membrane positioned inside said damper so as to create two separate spaces within said damper, said two spaces being a fluid space and an air space; and one or more springs positioned within said fluid space so as to counteract atmospheric pressure on said membrane from said air space and to stretch said membrane.

9. The fluid supply system of claim 8, wherein said damper comprises:

an air purging fitting.

10. A fluid supply system comprising:

an air lung able to deaerate fluid passing therethrough; and a moveable fluid pressure damper coupled to one or more print heads and coupled to said air lung via a pump, wherein said pump is able to pump unused fluid from said damper to said air lung.

11. The fluid supply system of claim 10 further comprising:

a fluid level bag coupled to said air lung and to said damper.

12. A fluid supply system comprising:

a closed collapsible bag positionable lower than nozzles of one or more print heads coupled to said system;

one or more sensors able to sense changes in volume of fluid present within said bag; and a pump coupled to said one or more sensors and to said collapsible bag, said pump able to pump additional fluid into said bag when said volume is less than a predetermine volume.

13. The system of claim 12, wherein said system is configured such that when printing fluid is exposed to the ambient atmosphere only at nozzles of said one or more print heads.

14. The system of claim 12, wherein said collapsible bag is positionable within a rigid casing.

* * * * *

UNITED STATES PATENT AND TRADEMARK OFFICE

CERTIFICATE OF CORRECTION

PATENT NO. : 6,485,137 B2
DATED : November 26, 2002
INVENTOR(S) : Karlinski, Haggai et al.

It is certified that error appears in the above-identified patent and that said Letters Patent is hereby corrected as shown below:

Column 8,
Line 65, please replace "a collapsible fluid level bag positionable higher than" with -- a collapsible fluid bag positionable lower than --

Signed and Sealed this

Thirty-first Day of August, 2004

JON W. DUDAS
*Director of the United States Patent and Trademark Office*